US005517938A

United States Patent [19]

Wood et al.

[11] Patent Number: 5,517,938

[45] Date of Patent: May 21, 1996

[54] DRAG INDUCING DROGUE FOR MULTIPLE TOWED ARRAYS

[75] Inventors: Edwin H. Wood, North Franklin; William G. Matthews, Baltic, both of Conn.

[73] Assignee: The United States of America as represented by the Secretary of the Navy, Washington, D.C.

[21] Appl. No.: 499,846

[22] Filed: Jul. 10, 1995

[51] Int. Cl.[6] ..... B63B 21/48

[52] U.S. Cl. ..... 114/311; 114/244

[58] Field of Search ..... 114/311, 293, 114/294, 242, 244, 245, 243; 244/1 TD

[56] References Cited

U.S. PATENT DOCUMENTS 4,562,788 1/1986 Abernethy ..... 114/311

5,016,556 5/1991 Abernethy ..... 114/311

*Primary Examiner*—Edwin L. Swinehart

*Attorney, Agent, or Firm*—Michael J. McGowan; Prithvi C. Lall; Michael F. Oglo

[57] ABSTRACT

The drogue of the present invention induces drag for a plurality of underwater tow lines. A tail section is axially movable within a nose section and extends partially therefrom. A tow line passes through the nose section and is coupled to the tail section. A rod is fixed to the nose section and extends through and axially away from the nose section into the tail section. A spring couples the nose section to the tail section such that the spring is placed in tension when the tail section and nose section are caused to move axially towards one another. In turn, the nose section and tail section are caused to move axially away from one another when the spring is allowed to relax. Drag wings mounted on the tail section are movable between a first minimal drag position and a second maximum position. Movement of an actuator mounted in the tail section causes corresponding movement of the drag wings between the first and second position. An engagement mechanism supported on the rod's aftmost end engages and moves the actuator in correspondence with movement of the spring. Clamping arms extend radially from the tail section and cooperate in pairs to clamp adjacent line drogues therebetween as the spring is placed in tension.

9 Claims, 4 Drawing Sheets

DRAG INDUCING DROGUE FOR MULTIPLE TOWED ARRAYS

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to underwater towed array systems, and more particularly to a drag inducing drogue for use with a plurality of underwater tow lines such as towed arrays.

(2) Description of the Prior Art

A variety of hydrodynamic drogue designs have been utilized with towed arrays. Some drogues simply produce a drag force which increases as a function of speed. Other drogues employ active or passive control apparatus that vary the drag force either on command or automatically as a function of speed, e.g., the constant drag drogue. However, regardless of design, conventional hydrodynamic drogues are only capable of operating with a single tow line.

SUMMARY OF THE INVENTION

Accordingly, it is an object of the present invention to provide a drag inducing drogue capable of generating hydrodynamic drag forces for a plurality of towed arrays.

Other objects and advantages of the present invention will become more obvious hereinafter in the specification and drawings.

The drogue of the present invention induces drag for a plurality of underwater line drogues, each of which can be attached to a towed sensor array. A nose section has an aft hollow portion and longitudinally oriented guide slots formed therein. A tow line passes through the nose section. A tail section is axially movable within the hollow portion of the nose section and extends partially from the nose section. The tow line passing through the nose section is coupled to the tail section such that tension in the line translates to the tail section. A rod is fixed to the nose section and extends through the aft hollow portion of the nose section and axially away from the nose section into the tail section. A spring is fixed between a forward portion of the tail section and a spring termination fixed to the rod at a location therealong aft of the forward portion. The spring couples the nose section to the tail section such that the spring is placed in tension when the tail section and nose section are caused to move axially towards one another. In turn, the nose section and tail section are caused to move axially away from one another when the spring is allowed to relax. Drag wings are mounted on the tail section and are movable between a first position that minimizes drag forces acting thereon and a second position that maximizes drag forces acting thereon. An actuator is mounted in the tail section and is coupled to the drag wings. Movement of the actuator causes corresponding movement of the drag wings between the first and second position. An engagement mechanism supported on the rod's aftmost end engages and moves the actuator such that the drag wings are moved to the first position when the spring is placed in tension. The engagement mechanism also moves and maintains the actuator such that the drag wings are moved to and maintained in the second position when the spring is allowed to relax. Clamping arms extend radially from the tail section and are driven through radial arcs by the longitudinally oriented guide slots in the nose section as the spring is placed in tension. The clamping arms cooperate in pairs to clamp line drogues therebetween as the spring is placed in tension. The line drogues run adjacent the drogue along the exterior of the nose and tail sections. A timer mounted in the drogue counts to a predetermined time after the spring is allowed to relax. At the predetermined time, the engagement mechanism is disengaged from the actuator so that the drag wings return to their first position due to drag forces acting thereon and the clamping arms release the line drogues.

BRIEF DESCRIPTION OF THE DRAWING(S)

Other objects, features and advantages of the present invention will become apparent upon reference to the following description of the preferred embodiments and to the drawings, wherein:

FIG. 1 is a side-view, partially cut away at the tail section, of the drag inducing drogue of the present invention prior to deployment where it is snubbed into a bellmouth;

FIG. 2 is a side-view, partially cut-away at the tail section, of the drag inducing drogue after deployment but prior to release of adjacent line drogues and collapse of the drag wings, FIG. 3 is a head-on cross-sectional view of the capture wings and synchronized gear assembly taken along line 3—3 of FIG. 2; and FIG. 4 is a side-view, partially cut away at the tail section, of the drag inducing drogue after the release of adjacent line drogues and collapse of the drag wings.

DESCRIPTION OF THE PREFERRED EMBODIMENT(S)

Figure 1:
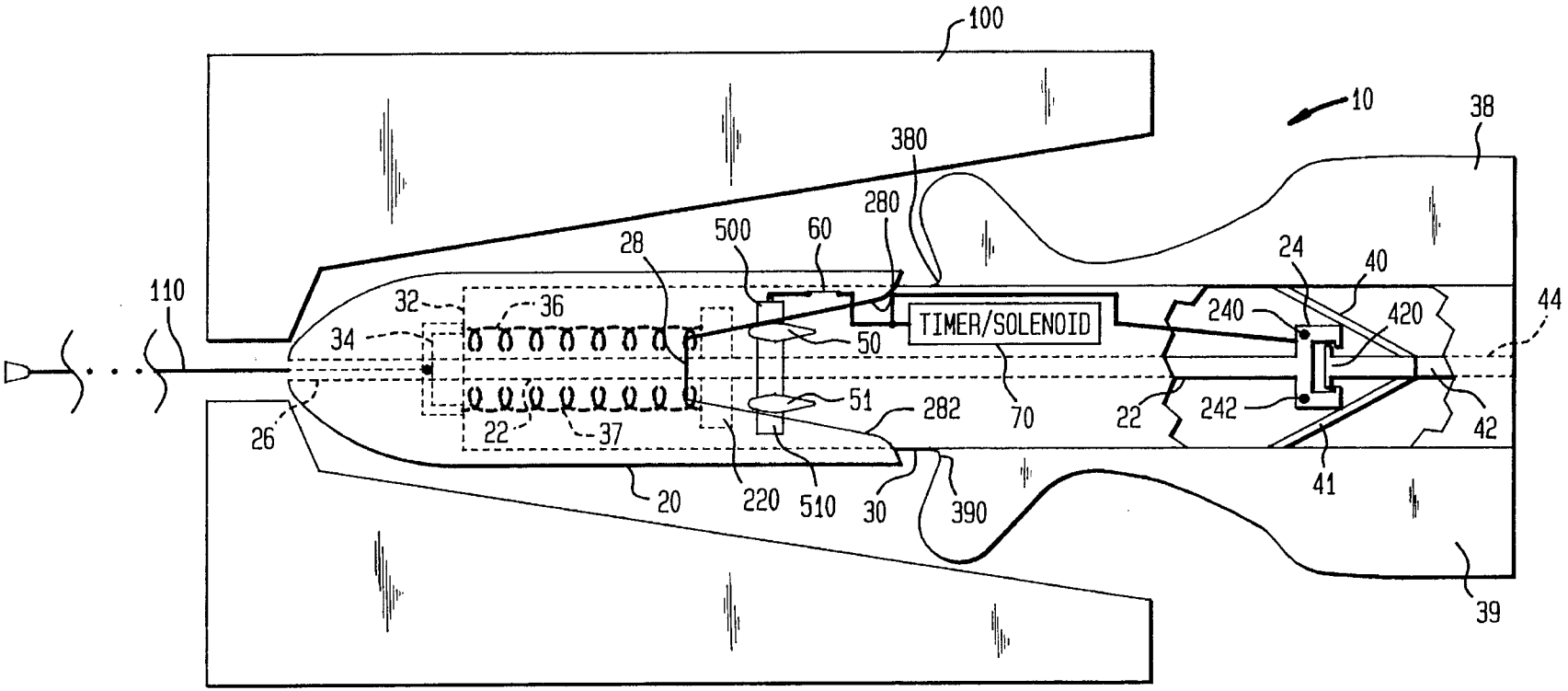
Figure 2:
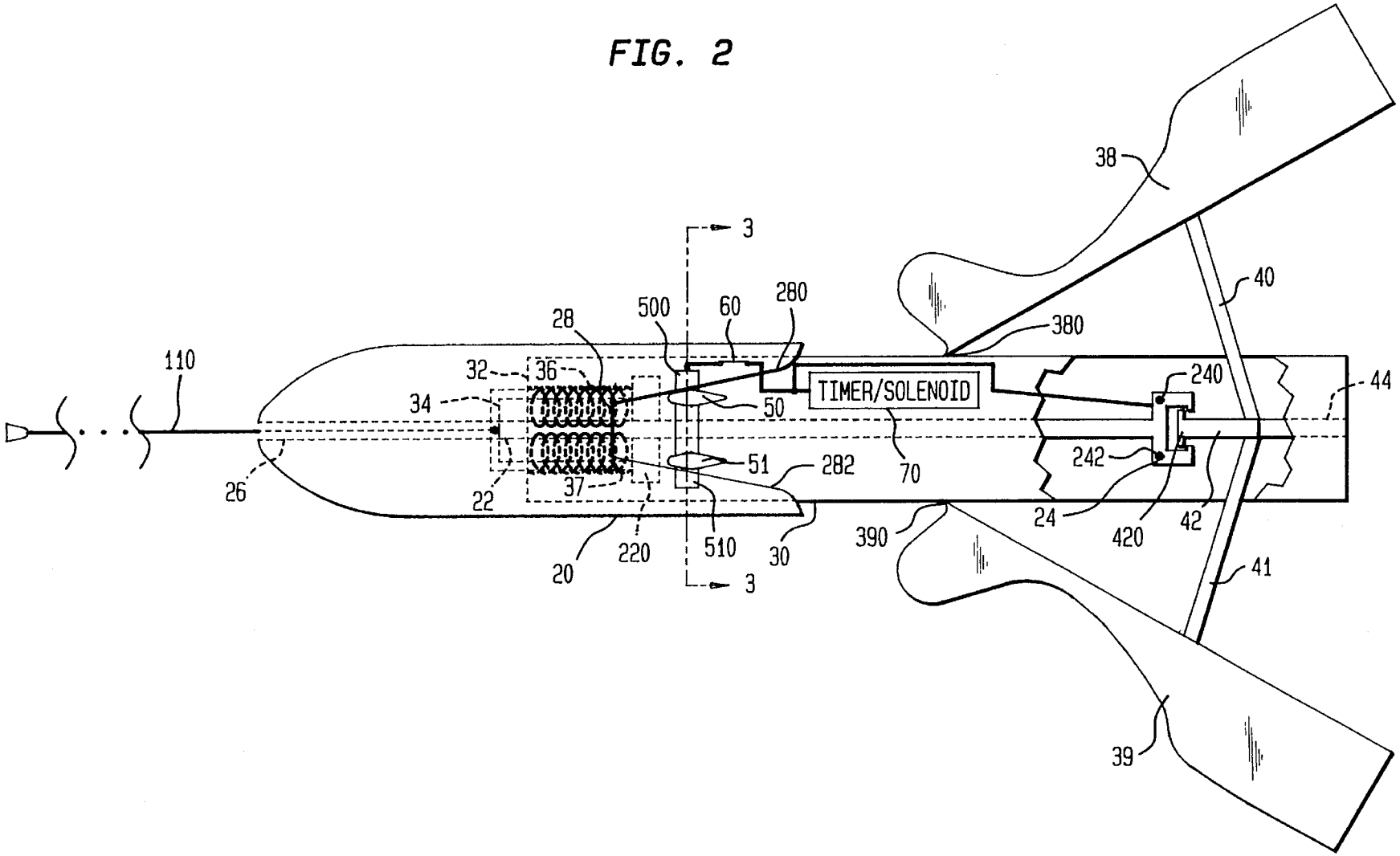
Figure 3:
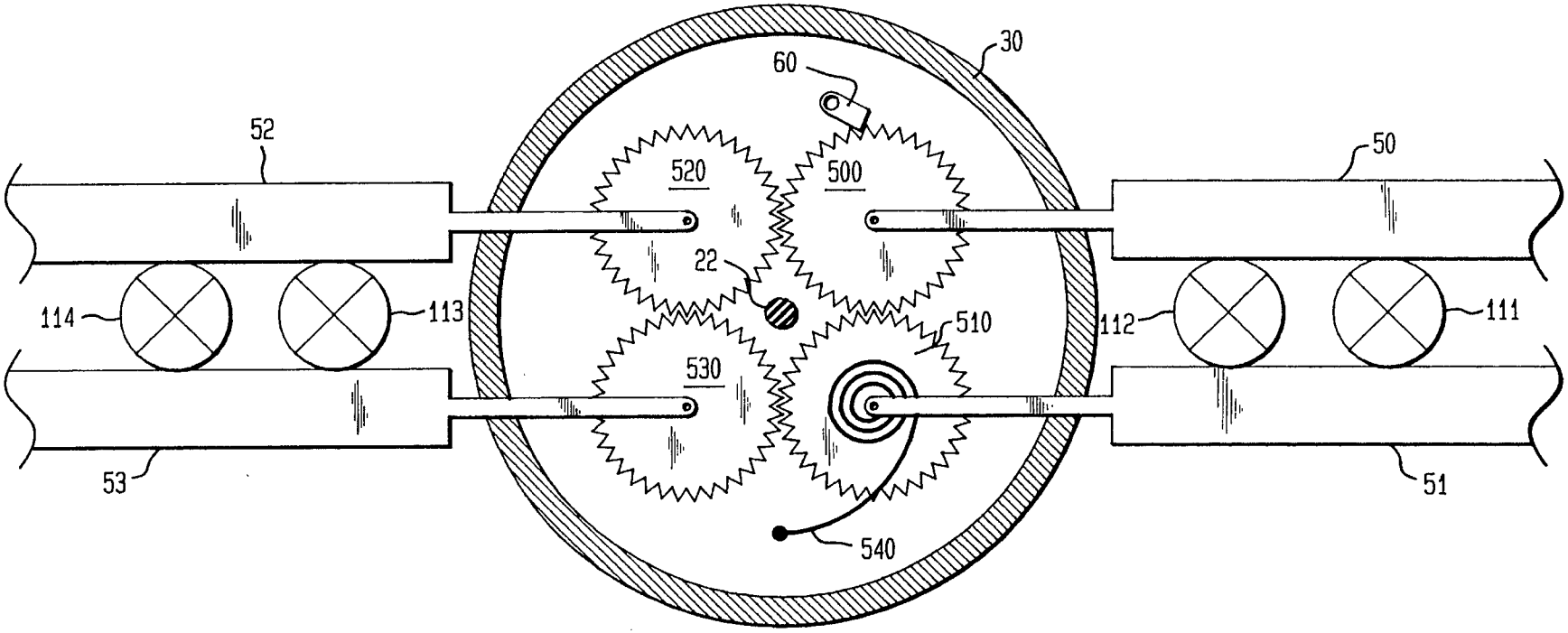
Figure 4:
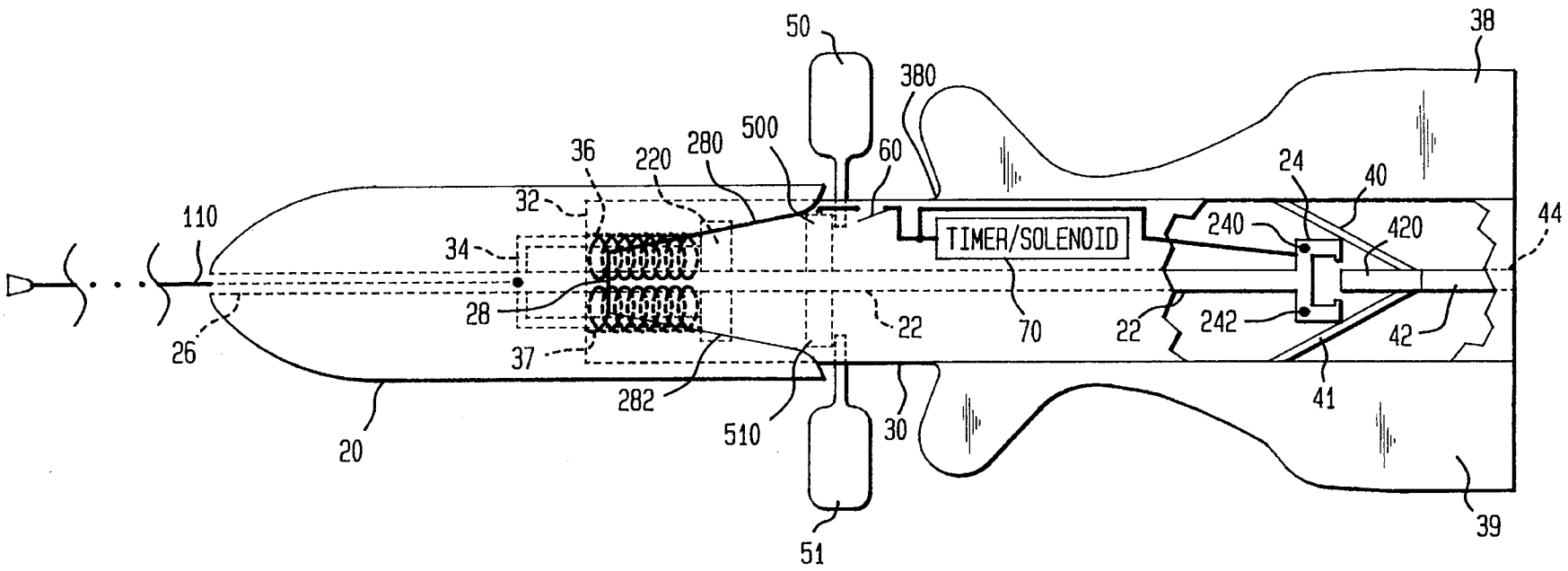

Referring now to the drawings, and in particular to FIGS. 1, 2, and 4, side views are shown of the drag inducing drogue of the present invention, indicated generally by reference numeral 10, in its various stages of operation. Briefly, FIG. 1 shows drogue 10 prior to deployment where it is snubbed into bellmouth 100 which is typically maintained onboard a ship (not shown) while FIGS. 2 and 4 show drogue 10 at different times after deployment. In each of FIGS. 1–4, like reference numerals have been used for those elements in common. Further, it is to be understood that the following detailed description is given by way of example since one skilled in the art could achieve the teachings of the present invention in a variety of different embodiments.

Drogue 10 has nose section 20 and tail section 30 partially received within a hollowed out portion of nose section 20. Nose section 20 incorporates rod 22 extending through the hollowed portion of nose section 20 and into tail section 30. Within tail section 30, rod 22 includes termination block 220 fixed thereto. Aft of termination block 220, rod 22 supports an engagement mechanism such as C-clamp 24 hinged about points 240 and 242. C-clamp 24 is capable of achieving a closed clamped position as shown and an open or releasing position as will be explained further below. Nose section 20 is further provided with slot 28 in its aft end defining shaped surfaces 280 and 282—the purpose of which will be described further below.

Tail section 30 is terminated at its forward bulkhead 32 with bracket 34. Bulkhead 32 and bracket 34 are designed to permit rod 22 to pass therethrough. Tow cable 110 passes through central axial bore 26 of nose section 20 and attaches to bracket 34 in an off-center fashion so as not to obstruct rod 22 extending through bracket 34 as shown in FIG. 2. Tow cable 110 is the tow cable for drag inducing drogue 10. A plurality of cables run adjacent to drogue 10 and are referred to herein as "line drogues". The line drogues, which are not shown in FIGS. 1, 2, and 4 for clarity of illustration, are attached to, for example, towed sensor arrays for applying a lesser drag force to the arrays.

Interconnecting nose section 20 and tail section 30 is a spring mechanism which, by way of example, is represented by springs 36/37. Springs 36/37 are connected to nose section 20 via termination block 220 and are connected to tail section 30 via forward bulkhead 32. Springs 36/37 are in tension in FIG. 1 and are relaxed in FIGS. 2 and 4. When allowed to relax, springs 36/37 provide a force that causes nose section 20 and tail section 30 to move axially away from one another.

Mounted at the aft end of tail section 30 are drag wings 38/39. While two such drag wings are shown, more can be used. Further, the present invention is not limited by the particular design configuration of the drag wing. Drag wings 38/39 are pivotally mounted to tail section 30 at locations 380/390, respectively. To move drag wings 38/39 between the position minimizing drag forces (shown in FIGS. 1 and 4) and the position maximizing drag forces (shown in FIG. 2), push rods 40/41 are fixedly connected between drag wings 38/39 and push rod actuator 42. Actuator 42 is movably mounted on axial guide rails 44 which are fixed within tail section 30. Actuator 42 is terminated with engagement head 420 which is to be engaged/disengaged by C-clamp 24 as will be explained further below in the operational description of the present invention.

With additional reference to FIG. 3, which is a head-on cross-sectional view taken along lines 3—3 of FIG. 2, line capture wings 50/51 are mounted to extend radially from nose section 30 forward of drag wings 38/39. Line capture wings 50/51 operate in synchronization to sweep through a radial arc about tail section 30 as driven by gears 500/510, respectively. Gears 500/510 are fixed to tail section 30 by means of conventional mounting plates or brackets (not shown for clarity of illustration). An additional pair of line capture wings 52/53 can be mounted on the opposite side of tail section 30 as shown in FIG. 3. Capture wings 52/53 can operate in synchronization with one another and with capture wings 50/51 by intermeshing gears 500/510/520/530 as shown in FIG. 3. Further, as will be apparent to one skilled in the art, additional pairs of capture wings and associated gears could be employed without departing from the scope of the present invention.

Pawl lock 60 cooperates with, for example, gear 500 to lock gears 500/510/520/530 in the clamped position about lines 111, 112, 113 and 114 which run adjacent to drogue 10 and represent the plurality of tow lines (in addition to tow cable 110) operated on by the present invention. Lines 110, 111, 112, 113 and 114 could be towed sensor arrays to be deployed by drogue 10. Although four line drogues are shown running adjacent to drogue 10, additional or fewer of such line drogues can be captured by line capture wings 50/51 and 52/53.

Finally, timer/solenoid 70 is connected to each of pawl lock 60 and C-clamp 24. Timer/solenoid 70 is a conventional timing and solenoid mechanism that simultaneously moves pawl lock 60 to allow movement of gear 500 and opens C-clamp 24 to disengage engagement head 420.

Operation of the present invention will now be described first for deployment of drogue 10 and then for retrieval of drogue 10. Prior to deployment, drogue 10 is snubbed into bellmouth 100 as shown in FIG. 1. Tow cable 110 is under tension thereby drawing tail section 30 into nose section 20 as springs 36/37 are placed in tension. Capture wings 50/51 are in their clamped position about adjacent line drogues (not shown in FIG. 1). Drag wings 38/39 are tucked against tail section 30 in the minimal drag position and maintained in such position by means of bellmouth 100. Further, C-clamp 24 captivates engagement head 420 of actuator 42.

When drogue 10 is to be deployed along with the line drogues captured by capture wings 50/51, etc., tension in cable 110 is relaxed thereby allowing springs 36/37 to relax which causes nose section 20 and tail section 30 to move axially away from one another. As drogue 10 releases from bellmouth 100, the timer operation of timer/solenoid 70 is initialized. Axial movement of nose section 20 relative to tail section 30 causes C-clamp 24 engaged with head 420 to move actuator 42 forward along axial guide rails 44. In turn, push rods 40/41 cause drag wings 38/39 to be pushed outward from tail section 30 where drag wings 38/39 are in the maximum drag position as shown in FIG. 2. Axial movement of nose section 20 relative to tail section 30 also causes capture wings 50/51 to be fully aft of nose section 20 while pawl lock 60 remains engaged with gear 500 to keep capture wings 50/51 in their clamped position about adjacent line drogues (e.g., line drogues 111, 112, 113 and 114).

When the timer operation of timer/solenoid 70 has counted to a time interval sufficient to allow the individual line drogues to develop drag to maintain their deployment independent of drogue 10, the solenoid operation of timer/solenoid 70 causes the release of pawl lock 60 from gear 500 and the release of C-clamp 24 from engagement head 420. Gears 500/510/520/530 are rotated under the spring force of spring 540 causing capture wings 50/51 and 52/53 to sweep through radial arcs such that line drogues 111, 112, 113 and 114 are released from their respective capture wings. To prevent any entanglement of the capture wings and line drogues, capture wings 50/51 (as well as capture wings 52/53) are rotated approximately 90° to the vertical position shown in FIG. 4. At the same time, drag forces cause the collapse of drag wing 38/39 against tail section 30 since actuator 42 is disengaged from C-clamp 24.

When drogue 10 and the deployed line drogues are to be retrieved, tow cable 110 and the remaining line drogues (e.g., line drogues 111, 112, 113 and 114) are reeled in through bellmouth 100. As drogue 10 is snubbed into bellmouth 100, nose section 20 is blocked from further movement while tension in cable 110 is maintained. The tension in cable 110 draws tail section 30 into nose section 20. Capture wings 50/51 (and capture wings 52/53) are thus rotated through radial arcs to their clamped position by means of shaped surfaces 280 and 282 pressing thereagainst. Simultaneously, C-clamp 24 is driven into engagement with engagement head 420 by rod 22.

The advantages of the present invention are numerous. The drogue need only attach to one tow cable yet is capable of physically imparting the necessary deployment force to a plurality of tow lines. Thus, there is no need for multiple mechanical drogues to deploy, for example, multiple towed sensor arrays. The clamping operation of the capture wings is activated simply by tension in the tow cable and the snubbing cooperation of the drogue and bellmouth. The same snubbing action sets a spring tension which is used to extend the drag wings when the drogue is deployed. The release of the capture wings and collapse of the drag wings is accomplished simply at a preset time after deployment. Thus, the drogue does not require any activation signal from a host or towing platform.

While the present invention has been described relative to a specific embodiment, it is not so limited. For example, the configuration of both the capture and drag wings could be adapted as needed. The spring mechanism linking the nose and tail sections of the drogue could be implemented in a variety of ways without departing from the present invention. Further, C-clamp 24 could be replaced with an electromagnet energized for engagement with engagement head 420. Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A drag inducing drogue, comprising:

a nose section having an aft hollow portion;

a tail section axially movable within said aft hollow portion and extending partially from said nose section;

spring means coupling said nose section to said tail section such that said spring means is placed in tension when said tail section and said nose section are caused to move axially towards one another, wherein said nose section and said tail section are caused to move axially away from one another when said spring means is allowed to relax;

drag wings mounted on said tail section and movable between a first position that minimizes drag forces acting thereon and a second position that maximizes drag forces acting thereon;

actuation means coupled between said nose section, said tail section and said drag wings for moving said drag wings from said first position to said second position when said spring means is relaxed, said actuation means further maintaining said drag wings in said second position in the presence of drag forces acting thereon; and clamping arms extending radially from said tail section and coupled to said spring means, said clamping arms cooperating in pairs for clamping a plurality of underwater line drogues therebetween when said spring means is placed in tension.

2. A drag inducing drogue as in claim 1 further comprising lock means for locking said clamping arms cooperating in pairs about said plurality of underwater line drogues when said spring means is placed in tension.

3. A drag inducing drogue as in claim 2 further comprising:

a timer for counting to a predetermined time after said spring means is allowed to relax; and means, coupled to said actuation means and said lock means, for disengaging said actuation means from said drag wings when said predetermined time is reached and for releasing said lock means when said predetermined time is reached, wherein said drag wings return to said first position due to drag forces acting thereon and wherein said clamping arms cooperating in pairs release said plurality of underwater line drogues.

4. A drag inducing drogue, comprising:

a nose section receiving therethrough one tow line, said nose section having an aft hollow portion;

a tail section axially movable within said aft hollow portion and extending partially from said nose section, said one tow line coupled to said tail section such that tension in said one tow line translates to said tail section;

a rod fixed to said nose section, said rod extending through said aft hollow portion and axially away from said nose section into said tail section;

spring means fixed between a forward portion of said tail section and a spring termination fixed to said rod at a location therealong aft of said forward portion, said spring means coupling said nose section to said tail section such that said spring means is placed in tension when said tail section and said nose section are caused to move axially towards one another, wherein said nose section and said tail section are caused to move axially away from one another when said spring means is allowed to relax;

drag wings mounted on said tail section and movable between a first position that minimizes drag forces acting thereon and a second position that maximizes drag forces acting thereon;

an actuator mounted in said tail section and coupled to said drag wings for moving said drag wings between said first position and said second position in correspondence with movement of said actuator;

engagement mechanism supported on said rod's aftmost end for engaging and moving said actuator such that said drag wings are moved to said first position when said spring means is placed in tension, and for moving and maintaining said actuator such that said drag wings are moved to and maintained in said second position when said spring means is allowed to relax; and clamping arms extending radially from said tail section and coupled to said forward portion, said clamping arms cooperating in pairs for clamping line drogues therebetween when said spring means is placed in tension.

5. A drag inducing drogue as in claim 4 further comprising lock means for locking said clamping arms cooperating in pairs about said line drogues when said spring means is placed in tension.

6. A drag inducing drogue as in claim 5 further comprising:

a timer for counting to a predetermined time after said spring means is allowed to relax; and means, coupled to said engagement mechanism and said lock means, for disengaging said engagement mechanism from said actuator when said predetermined time is reached and for releasing said lock means when said predetermined time is reached, wherein said drag wings return to said first position due to drag forces acting thereon and wherein said clamping arms cooperating in pairs release said line drogues.

7. A drag inducing drogue, comprising:

a nose section receiving therethrough a tow line, said nose section having an aft hollow portion, said aft hollow portion having longitudinally oriented guide slots formed therein;

a tail section axially movable within said aft hollow portion and extending partially from said nose section, said tow line coupled to said tail section such that tension in said one tow line translates to said tail section;

a rod fixed to said nose section, said rod extending through said aft hollow portion and axially away from said nose section into said tail section;

spring means fixed between a forward portion of said tail section and a spring termination fixed to said rod at a location therealong aft of said forward portion, said spring means coupling said nose section to said tail section such that said spring means is placed in tension when said tail section and said nose section are caused to move axially towards one another, wherein said nose section and said tail section are caused to move axially away from one another when said spring means is allowed to relax;

drag wings mounted on said tail section and movable between a first position that minimizes drag forces acting thereon and a second position that maximizes drag forces acting thereon;

an actuator mounted in said tail section and coupled to said drag wings for moving said drag wings between said first position and said second position in correspondence with movement of said actuator;

an engagement mechanism supported on said rod's aftmost end for engaging and moving said actuator such that said drag wings are moved to said first position when said spring means is placed in tension, and for moving and maintaining said actuator such that said drag wings are moved to and maintained in said second position when said spring means is allowed to relax; and clamping arms extending radially from said tail section, said clamping arms driven through radial arcs by said longitudinally oriented guide slots in said nose section as said spring means is placed in tension such that said clamping arms cooperate in pairs to clamp line drogues therebetween, said line drogues running adjacent said drag inducing drogue.

8. A drag inducing drogue as in claim 7 further comprising lock means for locking said clamping arms about said line drogues when said spring means is placed in tension.

9. A drag inducing drogue as in claim 8 further comprising:

a timer for counting to a predetermined time after said spring means is allowed to relax; and means, coupled to said engagement mechanism and said lock means, for disengaging said engagement mechanism from said actuator when said predetermined time is reached and for releasing said lock means when said predetermined time is reached, wherein said drag wings return to said first position due to drag forces acting thereon and wherein said clamping arms release said line drogues.

* * * * *